US007682995B2

(12) United States Patent
Stone et al.

(10) Patent No.: US 7,682,995 B2
(45) Date of Patent: Mar. 23, 2010

(54) TRIPLE LAYER INDUSTRIAL FABRIC FOR THROUGH-AIR DRYING PROCESS

(75) Inventors: Richard Stone, Carleton Place (CA); Dale B. Johnson, Ottawa (CA)

(73) Assignee: AstenJohnson, Inc., Charleston, SC (US)

( * ) Notice: Subject to any disclaimer, the term of this patent is extended or adjusted under 35 U.S.C. 154(b) by 2 days.

(21) Appl. No.: 10/566,938

(22) PCT Filed: Aug. 4, 2004

(86) PCT No.: PCT/CA2004/001446

§ 371 (c)(1), (2), (4) Date: Feb. 2, 2006

(87) PCT Pub. No.: WO2005/012634

PCT Pub. Date: Feb. 10, 2005

(65) Prior Publication Data

US 2006/0211320 A1 Sep. 21, 2006

(30) Foreign Application Priority Data

Aug. 4, 2003 (GB) ..... 0318220.1

(51) Int. Cl.
*D03D 11/00* (2006.01)
*D03D 13/00* (2006.01)

(52) U.S. Cl. ..... 442/206; 442/43; 442/46; 442/49; 442/76; 442/164; 442/203; 442/205; 442/207; 442/218; 442/220; 442/224; 442/226; 442/286

(58) Field of Classification Search ..... 442/43, 442/46, 49, 76, 164, 203, 205, 206, 207, 442/218, 220, 224, 226, 286
See application file for complete search history.

(56) References Cited

U.S. PATENT DOCUMENTS

| | | | | |
|---|---|---|---|---|
| 4,376,013 | A * | 3/1983 | Wang | 162/274 |
| 4,921,750 | A * | 5/1990 | Todd | 442/206 |
| 5,496,624 | A * | 3/1996 | Stelljes et al. | 428/131 |
| 5,555,917 | A * | 9/1996 | Quigley | 139/383 A |
| 6,349,749 | B1 * | 2/2002 | Quigley | 139/383 R |
| 2003/0178087 | A1 | 9/2003 | Odenthal | |

FOREIGN PATENT DOCUMENTS

| | | |
|---|---|---|
| CA | 1 188 556 | 6/1985 |
| CA | 1 248 799 | 1/1989 |
| CA | 2 220 653 | 7/1998 |
| CA | 2 228 297 | 3/1999 |
| CA | 2 390 612 | 12/2002 |
| EP | 1 311 723 | 5/2004 |

* cited by examiner

*Primary Examiner*—Andrew T Piziali
(74) *Attorney, Agent, or Firm*—Volpe and Koenig, P.C.

(57) ABSTRACT

A triple layer woven industrial fabric, particularly suitable for through-air drying applications, has a paper side (PS) layer and a machine side (MS) layer of polymeric warp and weft yarns woven to a repeat pattern wherein all the warp yarns are arranged as vertically stacked pairs, all the weft yarns comprise pairs of intrinsic weft binder yarns, and each pair of weft yarns forms an unbroken weft path in both the PS layer and the MS layer whereby when either the first or second member of the pair passes from the PS layer to the MS layer, the other member of the pair passes from the MS layer to the PS layer at an exchange point located between at least one common pair of warp yarns.

8 Claims, 4 Drawing Sheets

TRIPLE LAYER INDUSTRIAL FABRIC FOR THROUGH-AIR DRYING PROCESS

The present invention relates to industrial fabrics, more particularly to fabrics for use as through-air dryer fabrics to mold a web of cellulosic fibers into a three dimensional paper structure in a papermaking machine.

BACKGROUND OF THE INVENTION

In the manufacture of paper, an aqueous slurry of about 99% by weight of water and 1% by weight of cellulosic fibers and other papermaking constituents is deposited from a headbox onto a moving forming fabric, or in between two moving forming fabrics on a two-fabric papermaking machine. The web is initially formed and partially drained in the forming section, and is transported downstream where it is consolidated and dried by known means, such as conventional press dewatering in the press section, and evaporative drying in the dryer section. However, if the finished sheet is intended to have liquid absorbency properties, for end uses such as for tissue or towel, improved results can be obtained through the use of a through-air drying (TAD) instead of the conventional press and drying methods.

Water removal in a TAD process occurs as air is passed through the web and through the TAD fabric being used to support and convey the web through the TAD dryer section. This air movement molds the web to the surface topography of the TAD fabric, while removing most of the remaining moisture. The molding creates a more three dimensional web, thus increasing the thickness (known as bulk) of the finished web, which improves the efficacy of the finished product for applications such as tissue or towel. One means of imparting a desired topography to a TAD fabric is to apply a polymeric resin with precision in a desired pattern to the paper contacting, or paper side (PS), surface of the fabric.

Polymeric resin coated fabrics are well known, and have been described for example in U.S. Pat. No. 4,514,345 to Johnson et al., and U.S. Pat. Nos. 4,528,239, and 4,529,480 to Trokhan. Such resin coated structures generally comprise a reinforcing structure, referred to herein as a Acarrier fabric@, onto which a functional polymeric resin is deposited and subsequently pattern cured, for example by using a light source of activating wavelength through a mask. The resulting TAD fabric will generally have a macroscopically monoplanar patterned resinous network, either semicontinuous or discontinuous, on one surface.

The physical properties of the carrier fabric onto which the polymeric resin is to be deposited, and the balancing interaction between these properties, are critical to the effectiveness of the resultant TAD fabric. Some of the factors which affect the selection of these physical properties include the following:

Firstly, a high amount of projected open area, being the amount of open space per unit area projected through a fabric when viewed perpendicularly to the plane of the fabric, is required. Thus a woven carrier fabric must have a relatively open structure, in order to provide sufficient void volume for the polymeric resin in the finished TAD fabric, and to allow for the passage of sufficient air from the TAD dryer drum through the fabric and the web. If the carrier fabric is a closely woven structure, it will tend to become filled when the polymeric resin is applied, thus closing or unduly restricting the air passages.

Secondly, the carrier fabric must be dimensionally stable, and capable of resisting in-plane distortion such as is encountered when the fabric passes over bowed or spreader rolls in the papermaking machine. If the fabric does not have this stability, it may become narrowed or lengthened along its centre line, or suffer from creasing, or undulations across its width, any of which may impair its runnability and effectiveness. Such variations in the otherwise smooth planar nature of the fabric may cause localized variations in the paper product being conveyed by the fabric, which can lead to sheet breaks and a disruption in the operation of the papermaking machine.

Thirdly, the carrier fabric must be capable of being seamed effectively, preferably by a relatively narrow woven seam, which must be of sufficient strength to resist the longitudinal i.e. machine direction (MD) tensile forces to which the fabric is exposed. Typically, when a fabric such as this is prepared for a woven seam, the warp and weft yarns at the opposing fabric ends are unravelled and then rewoven into each other to form a seam region, usually having a width of between 5 and 12 inches. This woven seam must possess sufficient tensile strength so that the warp yarns resist sliding apart when the fabric and the seam are exposed to the expected MD tensile forces during use, which are typically up to 50 or 60 pounds per linear inch. One means of ensuring sufficient tensile strength at the woven seam is to impart sufficient crimp to the warp yarns during the fabric weaving, so that the yarns will have a greater resistance to sliding apart when the fabric is in use, and the seam will tend to have greater resistance to opening under longitudinal stress. If the crimp is insufficient for a given seam width, the warp yarns will tend to slide apart from the weft yarns, and the seam is more likely to fail. One means of ensuring that the warp yarns are crimped sufficiently to resist seam failure is to weave the fabric according to a plain weave pattern, which maximizes the number of crimps per unit length of the warp yarn.

Designers of carrier fabrics such as those of the prior art have been faced with the difficulty of meeting and reconciling these and other criteria. In particular, for an effective TAD fabric, it is necessary to provide a weave structure which has a high open area, while at the same time is woven to a pattern which provides sufficient yarn crimp to provide stability in each dimension, and to provide a durable seam.

Single layer TAD fabrics are well known and have been described in U.S. Pat. Nos. 5,839,479 and 5,853,547 to Wright et al. These patents teach that sheet bulk is enhanced by the use of cross direction (CD) yarns of alternating large and small diameters, the weave pattern in each case resulting in paper bulking depressions on the PS surface.

Double or multilayer fabrics have also been developed for use as TAD fabrics. For example, U.S. Pat. Nos. 5,496,624 and 5,840,411 to Stelljes each describe a double layer fabric which can be subjected to resin coating by means of a resinous pattern layer cast over the PS surface.

It has further been found that sheet bulk can be enhanced by the use of multilayer fabrics including vertically stacked yarns. For example in PCT Publication No. WO 03/006732 to Johnson et al., two sets of weft yarns are substantially vertically aligned, to urge the warp yarns into greater prominence on the PS surface; and alternatively, two sets of warp yarns can also be vertically stacked.

It is known to use pairs of either or both warp and weft yarns to bind together the layers of double or multilayer forming fabrics. For example, U.S. Pat. No. 5,826,627 to Seabrook et al. discloses a forming fabric including pairs of intrinsic weft binder yarns, which are weft yarns that contribute to the structure of both the PS and MS fabric surfaces, and also serve to bind these fabric layers together. However, other "regular" weft yarns are interspaced with the intrinsic weft binder yarns of this fabric.

Further, Application No. PCT/EP01/09398 to Odenthal shows a composite forming fabric comprising a PS layer having a plain weave pattern, formed of intrinsic weft pairs, one member of each pair also serving to bind together the PS and MS layers. However, in each pair the other member does not serve to bind the two layers together, and the long MS warp floats would contra-indicate use of this fabric as a TAD carrier fabric.

It has been found that an effective TAD carrier fabric can be successfully manufactured using a weave pattern in which all the weft yarns are arranged as pairs of intrinsic binder yarns, and are woven so as to bind together the warp yarns of each of the PS and MS layer, which are arranged in vertically stacked pairs. By the selection of an appropriate weave pattern, a high open area can be provided, enabling effective resin coating, and at the same time providing a dimensionally stable fabric having sufficient crimp in the warp yarns to allow for durable seaming.

SUMMARY OF THE INVENTION

The present invention therefore seeks to provide a triple layer woven industrial fabric having a paper side (PS) layer and a machine side (MS) layer comprising polymeric warp and weft yarns woven to a repeat pattern wherein:

(i) all of the warp yarns are arranged as vertically stacked pairs;

(ii) all of the weft yarns comprise pairs of intrinsic weft binder yarns each having a first and second member each of which contributes to the structure of both the PS and the MS layers of the fabric and binds together the PS and MS layers; and (iii) each pair of intrinsic weft binder yarns forms an unbroken weft path in both the PS layer and the MS layer, whereby when either the first or second member passes from the PS layer to the MS layer, the other member of the pair passes from the MS layer to the PS layer at an exchange point located between at least one common pair of warp yarns.

The present invention further seeks to provide a woven triple layer industrial fabric which is suitable for resin coating for use as a through-air dryer fabric for a papermaking machine.

The fabrics of the present invention are unique in that the warp yarns are vertically stacked and paired, and are interwoven with pairs of intrinsic weft binder yarns so as to provide a triple layer fabric structure. The combination of stacked warp yarns and pairs of intrinsic weft binder yarns allows the fabrics of this invention to be woven so as to provide a high projected open area while, at the same time, providing adequate dimensional stability, stretch resistance and seam strength.

In particular, in a preferred embodiment, each of the MS and PS layers are woven according to the same weave pattern, which is preferably a plain weave. The fabric is woven so as to have a projected open area of at least 35%, and an air permeability of at least 850 cubic feet per minute (cfm). The high open area facilitates the retention and adhesion of a polymeric coating of the fabric which may be arranged according to a desired pattern, while ensuring that, after coating, sufficient air movement is allowed through the fabric. The use of intrinsic weft binder yarn pairs in combination with the stacked warp yarn arrangement provides the fabric with enhanced dimensional stability, to resist distortion. The use of a plain weave pattern for both the MS and the PS layers imparts sufficient crimp to the warp yarns such that the seams are able to withstand greater amounts of longitudinal tension than comparable seams formed in fabrics using other weave patterns.

Further, the weave pattern is selected to maximize the number of yarn knuckles on the PS surface of the PS layer, which is the surface to receive the resin coating. This serves to improve the attachment of resin coating to the fabric by providing a large number of surface features which can be encapsulated by the resin.

DETAILED DESCRIPTION

In the context of this invention, the following terms have the following meanings:

"Intrinsic weft binder yarns" are weft yarns which are interwoven with the other fabric yarns so as to contribute to the structure of the PS surface of the PS layer, and to the structure of the MS surface of the MS layer, and also serve to bind the PS and the MS layers together; and "Projected open area" is the amount of open space per unit area projected through a fabric when viewed perpendicularly to the plane of the fabric.

In the fabrics of this invention, all the weft yarns are woven as intrinsic weft binder yarns.

The invention will now be described by way of reference to the Figures, in which FIG. 1 is a photographic isometric view of a first embodiment of the invention;

Figure 1:
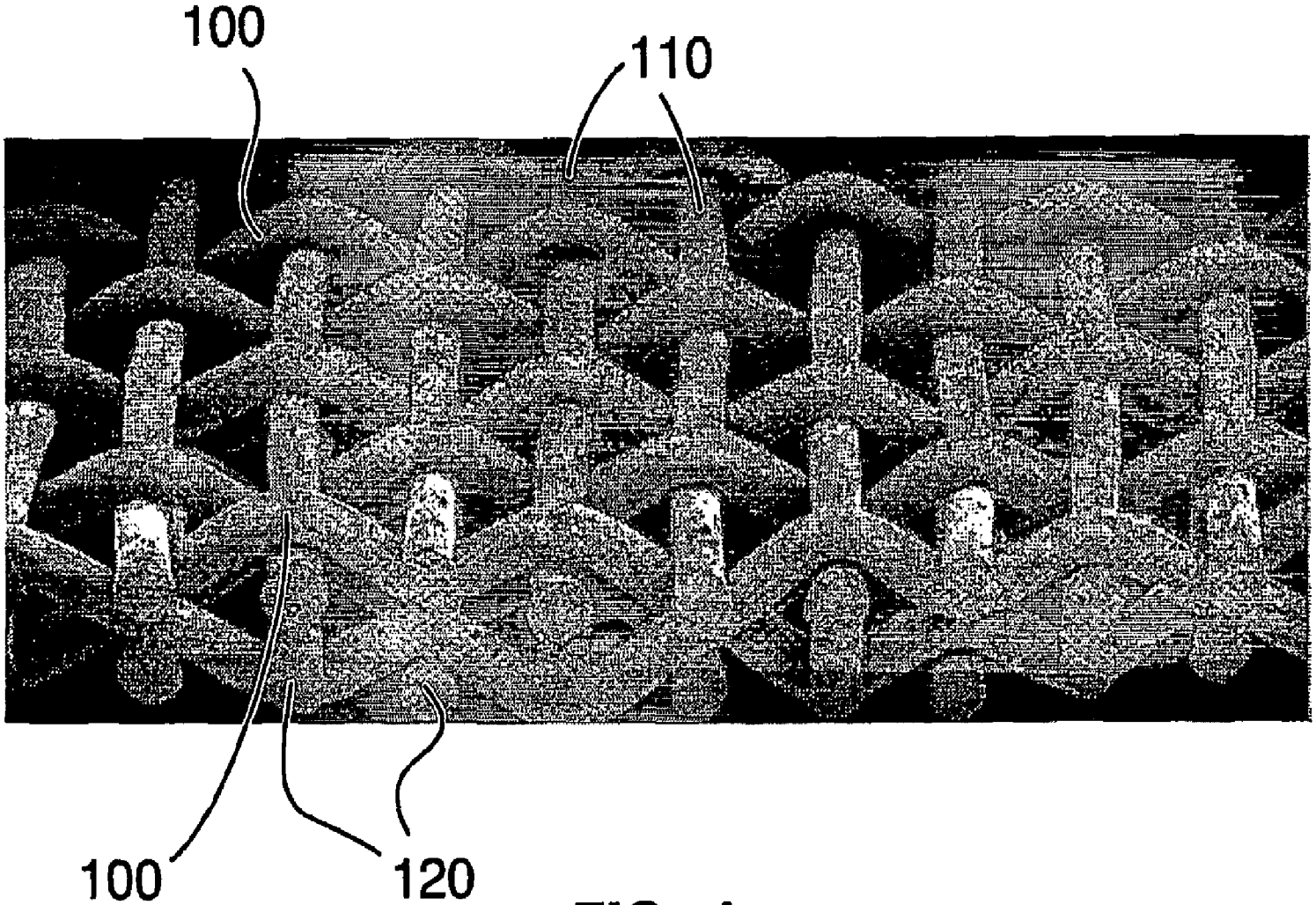

Referring to FIG. 1, it can be seen that the fabric of this embodiment is woven to a plain weave design in each of the PS layer 70 and the MS layer 80, to which each member of each pair of weft yarns, identified by the generic reference numeral 100, contributes. In each embodiment, the paths of each member of each pair of weft yarns 100 in each repeat comprise two portions, so that each member alternates between the PS layer 70 and the MS layer 80, and so that between the first and second portions of the repeat, the first and second members of the pair of weft yarns 100 exchange positions at an exchange point 90. In the first portion, the first member is exposed over a preselected number N1 of PS warp yarns identified by the generic reference numeral 110, while the second member is exposed over a preselected number N2 of MS warp yarns identified by the generic reference numeral 120. In the second portion, after the exchange of the two members of the pair of weft yarns 100, the first member is exposed over a preselected number M1 of MS warp yarns 120 while the second member is exposed over a preselected number M2 of PS warp yarns 110.

Referring to FIGS. 2A to 2D, the paths in the CD of four successive pairs of weft yarns 100 are shown. For each pair, a first member is shown by a solid line and ascribed an even number 30, 32, 34, and 36, and the second member is shown by a broken line and ascribed an odd number 31, 33, 35 and 37. These numbers correspond with the weft yarn numbering indicated at the left side of the weave diagram of FIG. 4.

In the PS layer, a first set of warp yarns 110, shown as the odd numbered yarns forming the upper layer in FIGS. 1A to 1D, is vertically aligned with a second set of warp yarns 120, shown as the even numbered yarns forming the lower layer in FIGS. 1A to 1D, to form vertically stacked pairs. These numbers correspond with the warp yarn numbering indicated across the top of the weave diagram of FIG. 4.

Figure 2A:
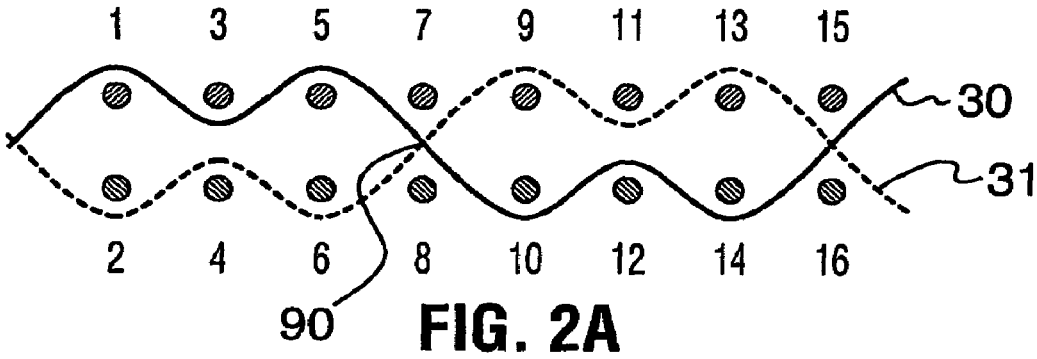
FIGS. 2A to 2D show the paths in the CD of four successive weft yarn pairs of the embodiment of FIG. 1.
Figure 2B:
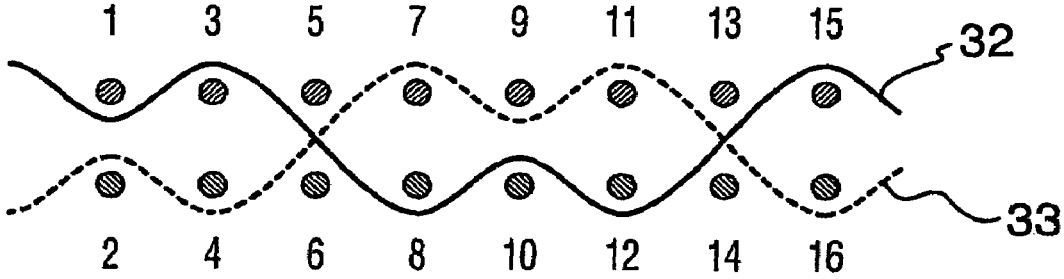
Figure 2C:
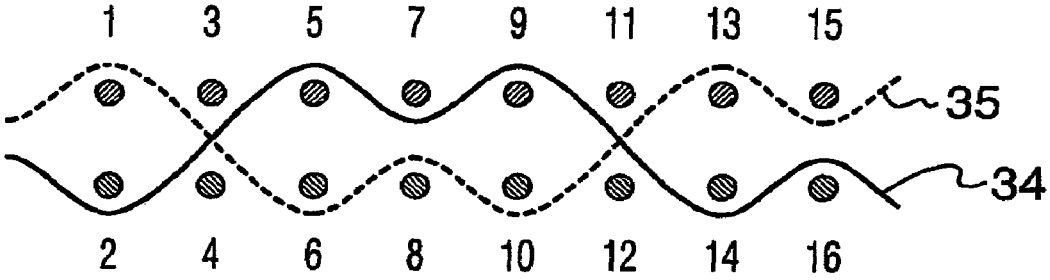
Figure 2D:
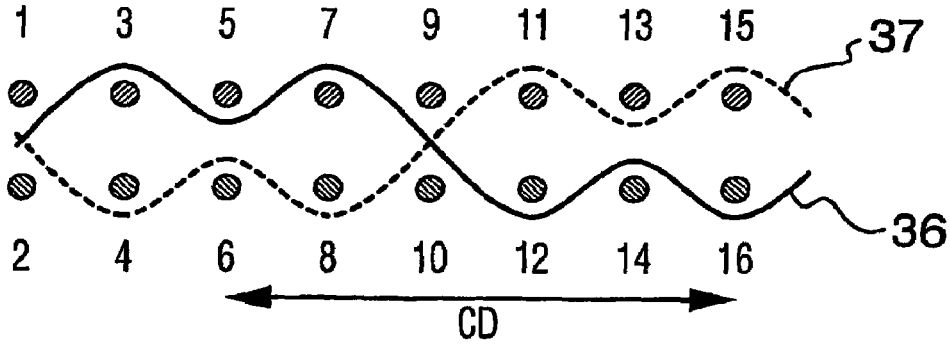

In the first embodiment, as can be seen for example in relation to first and second members 30 and 31 in FIG. 2A, the two members of each pair of weft yarns 100 follow an identical path, the path of the second member 31 being displaced by one-half of a pattern repeat from the first member 30. In this embodiment, the first member 30 in a first portion of the repeat pattern is exposed over two PS warp yarns 1 and 5, and then switches to the MS layer, passing under PS warp yarn 7 and over MS warp yarn 8, whence it follows a second portion of the repeat pattern, being exposed over two MS warp yarns 10 and 14. At the same time, the second member 31 in a first portion of the repeat pattern is exposed over two MS warp yarns 2 and 6, and then switches to the PS layer, also passing under PS warp yarn 7 and over MS warp yarn 8, whence it follows a second portion of the repeat pattern, being exposed over two PS warp yarns 9 and 13. A second exchange point 90 occurs between PS warp yarn 15 and MS warp yarn 16. Thus it can be seen that the two members 30 and 31 exchange positions at an exchange point 90 between the vertically stacked pair of warp yarns 7 and 8. Similarly, with reference to FIGS. 1B, 1C and 1D, each pair of weft yarns follows the same path, displaced by an appropriate number of PS and MS warp yarns, 110 and 120. It can be seen that for this embodiment, N1=N2=M1=M2=2.

Figure 3:
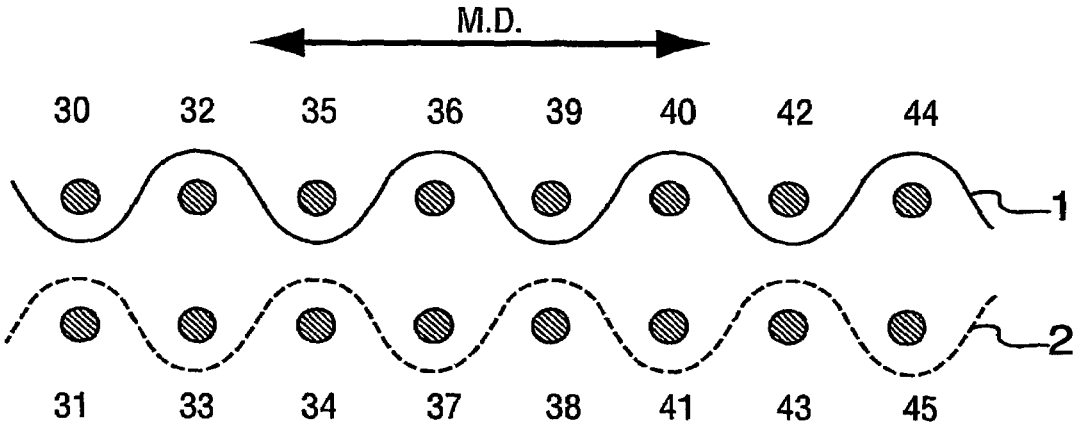
FIG. 3 shows the path in the MD of one stacked pair of warp yarns of the embodiment of FIG. 1.

Referring to FIG. 3, the warp path in the MD of the first stacked pair of warp yarns 110 and 120 is shown, the PS warp yarn being shown as yarn 1 and the MS yarn being shown as yarn 2. These yarns, and the weft yarns 100, are identified to correspond with the numbering in the weave diagram of FIG. 4.

Figure 4:
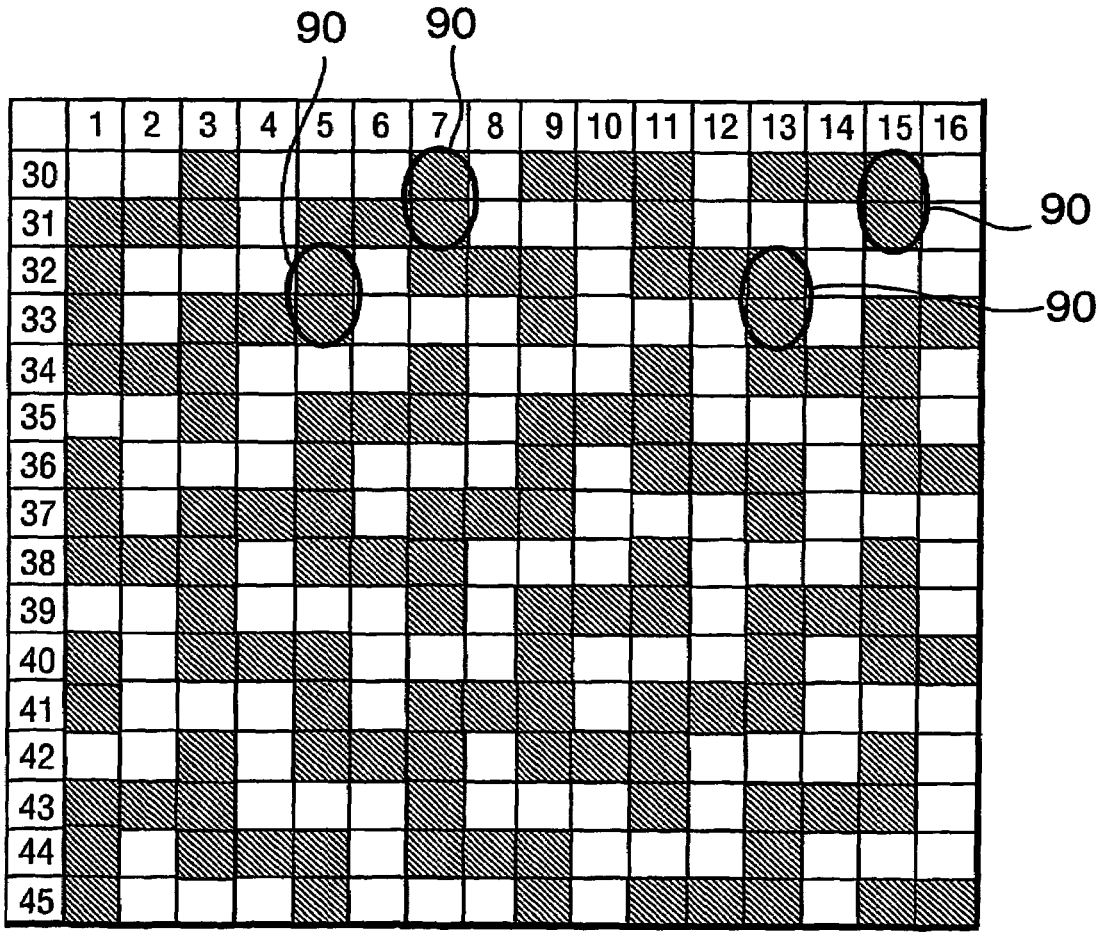
FIG. 4 is a weave diagram showing one repeat of the weave pattern of the embodiment of FIG. 1.

Referring to FIG. 4, some examples of the exchange points 90 are indicated. These occur, for example, for weft yarns 30 and 31, between warp yarns 7 and 8, and 15 and 16. Similarly, exchange points for weft yarns 32 and 33 occur between warp yarns 5 and 6, and 13 and 14; and for weft yarns 34 and 35 between warp yarns 3 and 4, and 11 and 12.

Figure 5A:
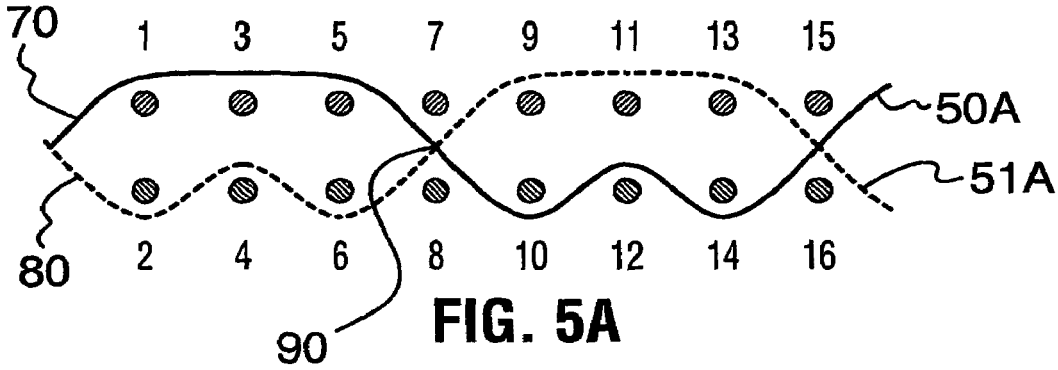
FIGS. 5A to 5C show respectively the paths of one weft yarn pair of a second, third and fourth embodiment of the invention.
Figure 5B:
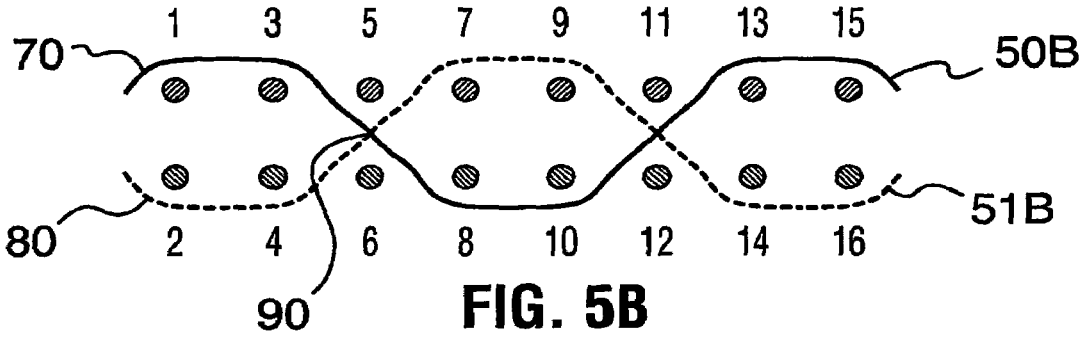
Figure 5C:
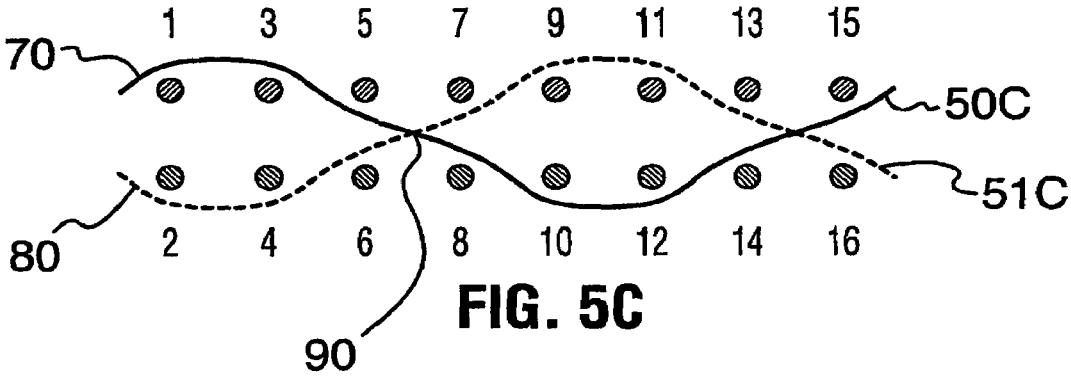

Referring to FIGS. 5A, 5B and 5C, three further embodiments of a fabric according to the invention are shown. In FIG. 5A, each member of the weft pair, identified as 50A and 51A, follows an identical path, displaced by one-half of the repeat, and the two members exchange positions in the PS layer 70 and the MS layer 80 at exchange points 90. However, in the PS surface of the PS layer 70, the weave pattern is a 3/1 broken twill, whereas the weave pattern for the MS surface of the MS layer 80 remains a plain weave. In this embodiment, N1=M2=3, and N2=M1=2.

Similarly, in FIG. 5B, each member of the weft pair, identified as 50B and 51B, follows an identical path, displaced by one-half of the repeat, and the two members exchange positions in the PS layer 70 and the MS layer 80 at exchange points 90. However, in both the PS surface of the PS layer 70 and the MS surface of the MS layer 80, the weave pattern is a 2/1 twill. In this embodiment, N1=N2=M1=M2=2.

FIG. 5C shows an embodiment similar to that shown in FIG. 5B. However, the weave pattern in both the PS surface of the PS layer 70 and the MS surface of the MS layer 80 is a 2/2 basket weave, and the exchange points occur between two adjacent pairs of stacked warp PS yarns 110 and MS yarns 120. Thus, the first exchange point 90 for weft yarns 50C and 51C in FIG. 5C occurs below both PS warp yarns 5 and 7 and above both MS warp yarns 6 and 8.

As noted above, the fabrics of this invention have a high projected open area, which after heatsetting is at least 35%, and is preferably between 35% and 50%. These values are necessary to allow sufficient passage of air from the TAD drum through the sheet, particularly where a patterned resin coating is applied to the fabrics. Further, the fabrics of this invention have an air permeability, after heatsetting, within the range of 800 to 1200 cubic feet per minute per square foot. More preferably, the fabrics of the invention have an air permeability in the range of 900 to 110 cubic feet per minute per square foot.

It has been found that the preferable mesh ranges for the fabrics of this invention are between 35×2 (warp) by 25×2 (weft) and 50×2 (warp) by 40×2 (weft) per inch, so that the mesh ranges, without regard to the stacking of the warp yarns 110 and 120 and the paired weft yarns 100, are between 70 to 100 for the warp and 50 to 80 for the weft. Taking into account the stacking of the warp yarns and the pairing of the weft yarns as intrinsic weft binder yarns, the effective mesh ranges of the fabric are from 35-50 warp/in. and 25-40 weft/in. The effective mesh is that which is seen when determining projected open area.

When used as carrier fabrics for a TAD process, the yarns used for both the warps and the wefts in the fabrics of the invention must be resistant to both heat and hydrolytic degradation. Suitable materials both for the warp yarns 110 and 120 and for the weft yarns 100 include polyetheretherketone, polyphenylene sulphide, polyethylene terephthalate, and polycyclohexamethalyne terephthalate, acid modified. The materials used for the MS warps can be different from the materials used for the PS warps or for the wefts. Other polymeric materials such as are commonly used for industrial fabrics, may be appropriate in applications other than for a TAD process.

It has been found that suitable yarn sizes for the fabrics of the invention are a minimum of 0.18 mm for the weft yarns 100, and a minimum of 0.20 mm for the warp yarns 110 and 120. However, other yarn sizes may be selected depending on the intended use for the fabric.

We claim:

1. A triple layer industrial fabric having a paper side (PS) layer and a machine side (MS) layer comprising polymeric warp and weft yarns woven to a repeat pattern wherein:

(i) all of the warp yarns are arranged as vertically stacked pairs;

(ii) all of the weft yarns comprise pairs of intrinsic weft binder yarns, each having a first and second member each of which contributes to the structure of both the PS and the MS layers of the fabric and binds together the PS and MS layers;

(iii) for each pair of the intrinsic weft binder yarns, the first and second members of the pair follow complementary identical paths in which the two pair members alternate with each other to appear in turn in the PS layer and the MS layer and cooperate to define a single continuous weft yarn path in both the PS layer and the MS layer whereby (a) when either the first or second member passes from the PS layer to the MS layer, the other member of the pair passes from the MS layer to the PS layer at an exchange point located between at least one common pair of warp yarns; and (b) the members of each pair are in adjacent contact at each of the exchange points; and (iv) at least one of the PS layer and the MS layer is woven to a plain weave pattern.

2. A triple layer industrial fabric as claimed in claim 1, wherein the PS layer has an exposed PS surface and the MS layer has an exposed MS surface; and wherein (i) in a first portion of the repeat pattern, the first member is exposed in the PS surface over a number (N1) of PS warp yarns while the second member is exposed in the MS surface over a number (N2) of MS warp yarns;

(ii) in a second portion of the repeat pattern the first member is exposed in the MS surface over a number (M1) of MS warp yarns while the second member is exposed in the PS surface over a number (M2) of PS warp yarns; and (iii) relationships between values of N1, N2, M1 and M2 are selected from (a) the value of N1 is equal to the value of N2, and the value of M1 is equal to the value of M2;

(b) the value of N1 is equal to the value of M2, and the value of N2 is equal to the value of M1; and (c) the values of each of N1, N2, M1 and M2 are equal.

3. A triple layer industrial fabric as claimed in claim 1 wherein for each unit area, viewed substantially perpendicularly to the PS surface of the PS layer or the MS surface of the MS layer, an open space projected through the fabric has an area in a range of 35% to 50% of the unit area.

4. A triple layer industrial fabric as claimed in claim 1 wherein the fabric has an air permeability in a range of 800 to 1200 cubic feet per minute per square foot.

5. A triple layer industrial fabric as claimed in claim 4 wherein the fabric has an air permeability in a range of 900 to 1100 cubic feet per minute per square foot.

6. A triple layer industrial fabric as claimed in claim 1 wherein the polymeric yarns are made from at least one material selected from the group polyetheretherketone, polyphenylene sulphide, polyethylene terephthalate, and polycyclohexamethalyne terephthalate, acid modified.

7. A triple layer industrial fabric as claimed in claim 1 wherein the PS surface of the PS layer of the fabric has a polymeric resinous coating.

8. A triple layer industrial fabric having a paper side (PS) layer and a machine side (MS) layer comprising polymeric warp and weft yarns woven to a repeat pattern wherein:

(i) all of the warp yarns are arranged as vertically stacked pairs;

(ii) all of the weft yarns comprise pairs of intrinsic weft binder yarns, each having a first and second member each of which contributes to the structure of both the PS and the MS layers of the fabric and binds together the PS and MS layers;

(iii) for each pair of the intrinsic weft binder yarns, the first and second members of the pair follow identical complementary paths in which the two pair members define a respective plane extending in the weft direction in which the pair members cooperate to define a continuous weft yarn path in both the PS layer and the MS layer whereby (a) when either the first or second member passes from the PS layer to the MS layer, the other member of the pair passes from the MS layer to the PS layer at an exchange point located between at least one common pair of warp yarns; and (b) the members of each pair are in adjacent contact at each exchange point; and (iv) at least one of the PS layer and the MS layer is woven to a plain weave pattern.

* * * * *